United States Patent [19]

Takano et al.

[11] Patent Number: 4,616,583

[45] Date of Patent: Oct. 14, 1986

[54] THREAD TIGHTENING CONTROL APPARATUS OF AUTOMATIC SEWING MACHINE

[75] Inventors: Kunio Takano, Tokyo; Masanori Nukushina, Kanagawa, both of Japan

[73] Assignee: Tokyo Juki Industrial Co., Ltd., Tokyo, Japan

[21] Appl. No.: 767,584

[22] PCT Filed: Dec. 27, 1984

[86] PCT No.: PCT/JP84/00622

§ 371 Date: Aug. 7, 1985

§ 102(e) Date: Aug. 7, 1985

[87] PCT Pub. No.: WO85/03093

PCT Pub. Date: Jul. 18, 1985

[30] Foreign Application Priority Data

Dec. 29, 1983 [JP] Japan ..... 58-251446

[51] Int. Cl.[4] ..... D05B 21/00; D05B 47/04

[52] U.S. Cl. ..... 112/121.12; 112/254; 112/314

[58] Field of Search ..... 112/254, 255, 121.12, 112/453, 456, 314

[56] References Cited

U.S. PATENT DOCUMENTS

| | | | |
|---|---|---|---|
| 4,370,938 | 2/1983 | Bergvall | 112/453 |
| 4,377,980 | 3/1983 | Hanyu et al. | 112/254 |
| 4,566,396 | 1/1986 | Sakuma et al. | 112/453 |

*Primary Examiner*—Peter Nerbun

*Attorney, Agent, or Firm*—Wenderoth, Lind & Ponack

[57] ABSTRACT

A thread tightening control apparatus according to the present invention is capable of tightening upper and under threads accurately and in good order, irrespective of fabric thickness, by the relative movement between a needle and a fabric holding body.

The apparatus is provided with setting means capable of generating a plurality of setting signals of different timings at which the drive pulses are to be supplied to the drive means in dependence upon fabric thickness. Shifting means is operable in association with a selected setting signal for moving a period during which drive means is supplied with drive pulses by the actuating means forward or backward with respect to a predetermined rotational angle of a spindle. As a result, the distance between the tip of the needle and the surface of the fabric at the completion of fabric feed is set to a predetermined minimum length irrespective of fabric thickness.

3 Claims, 6 Drawing Figures

THREAD TIGHTENING CONTROL APPARATUS OF AUTOMATIC SEWING MACHINE

TECHINICAL FIELD

This invention relates to a thread tightening control apparatus for tightening upper and under threads by the relative movement between a needle and a fabric holding body in an automatic sewing machine in which a seam of a predetermined shape is formed while the fabric holding body holding an article to be stitched is moved horizontally relative to a needle and then halted.

PRIOR ART

In a sewing machine of this kind, the fabric holding body is moved a predetermined amount during a period of time from an instant ($t_0$), at which the tip of the needle is raised to a point above the needle plate, to an instant ($t_1$), at which the tip of the needle is again lowered to a point below the needle plate, as shown in FIG. 6. In particular, in order to perform thread tightening fully, timing for completion of fabric feed (fabric holding body movement) is brought close to the instant $t_1$. That is to say, when a needle 4 is at a great height at completion of movement of a fabric W in a direction F, as shown in FIG. 2, the length of the thread from an immediately preceding needle descent point to the next needle descent point becomes excessively large. Then, when the needle is lowered to stitch the seam followed by raising a take-up lever, the upper thread fails to be taken up fully by the lifting of the upper thread performed by the take-up lever. The result is diminished thread tightening. Accordingly, unsatisfactory thread tightening is prevented by adopting a fabric feed completion timing (feed tightening) that will result in the lower end of the needle 4 coming as close as possible to the fabric surface.

When fabric feed completion timing is constant in the above-described arrangement, the needle contacts and, hence, damages the fabric prior to completion of fabric feed if the fabric is thick. For a thin fabric, on the other hand, thread tightening is unsatisfactory for the above-mentioned reasons. Accordingly, it is necessary to adjust the fabric feed timing in dependence upon fabric thickness. In order to perform this adjustment in the conventional arrangement, however, an adjustment screw disposed inside the sewing machine is tightened or loosened to move a prescribed adjustment member. This operation requires a high level of technical knowledge and skill. Another drawback is that the adjustment takes time owing to the complexity thereof.

SUMMARY OF THE INVENTION

Object of the Invention

An object of the present invention is to provide a thread tightening apparatus in a cycle sewing machine adapted to establish relative movement between a needle and a fabric holding body by electrical drive means such as stepping motors, which apparatus makes it possible to adjust the timing of the relative movement between the needle and the fabric holding body, which are to perform the feed tightening, by a manually operable switch with ease and without the need for a high level of technical knowledge.

Another object of the present invention is to provide a thread tightening control apparatus of an automatic sewing machine which makes it possible to perform uniform and highly satisfactory thread tightening even when there is a change in the thickness of a fabric being stitched.

The present invention has been devised to attain the foregoing objects and provides a thread tightening control apparatus of an automatic sewing machine comprising:

a needle rod having a needle secured to a lower end thereof and movable up and down in operative association with a spindle;

a fabric holding body for holding a fabric at a lower end thereof and movable along a horizontal direction relative to the needle rod;

drive means coupled to the fabric holding body and operated by elecrical drive pulses for driving the fabric holding body in a horizontal direction with respect to a needle descent point;

memory means for storing feed data which determine the amount of movement of the fabric holding body for each and every seam;

pulse generating means synchronized to the spindle for generating pulse signals of a constant period and of a number proportional to the rotational speed of the spindle;

actuating means for supplying the drive means with drive pulses in a period during which the needle is clear of the fabric in synchronism with the pulse signals and on the basis of the feed data in the memory means;

setting means capable of generating a plurality of setting signals of different timings at which the drive pulses are to be supplied to the drive means in dependence upon fabric thickness; and shifting means operable in association with the setting signals for moving a period during which the drive means is supplied with drive pulses by the actuating means forward or backward with respect to a predetermined rotational angle of the spindle.

In a preferred embodiment of the present invention, the drive means is capable of driving the fabric holding body along perpendicularly intersecting X and Y axes lying in a horizontal plane, and the actuating means is adapted to supply drive signals in relation to the amount of movement of the fabric holding body along the X or Y axis, whichever is greatest. In another preferred embodiment of the present invention, the pulse generating means comprises a rotary body secured to the spindle and having equidistantly spaced slits along the circumference thereof, as well as light-emitting means and light-receiving means arranged to oppose each other across the rotary body interposed therebetween.

EMBODIMENT

An embodiment of the present invention will now be described with reference to the drawings.

Figure 1:
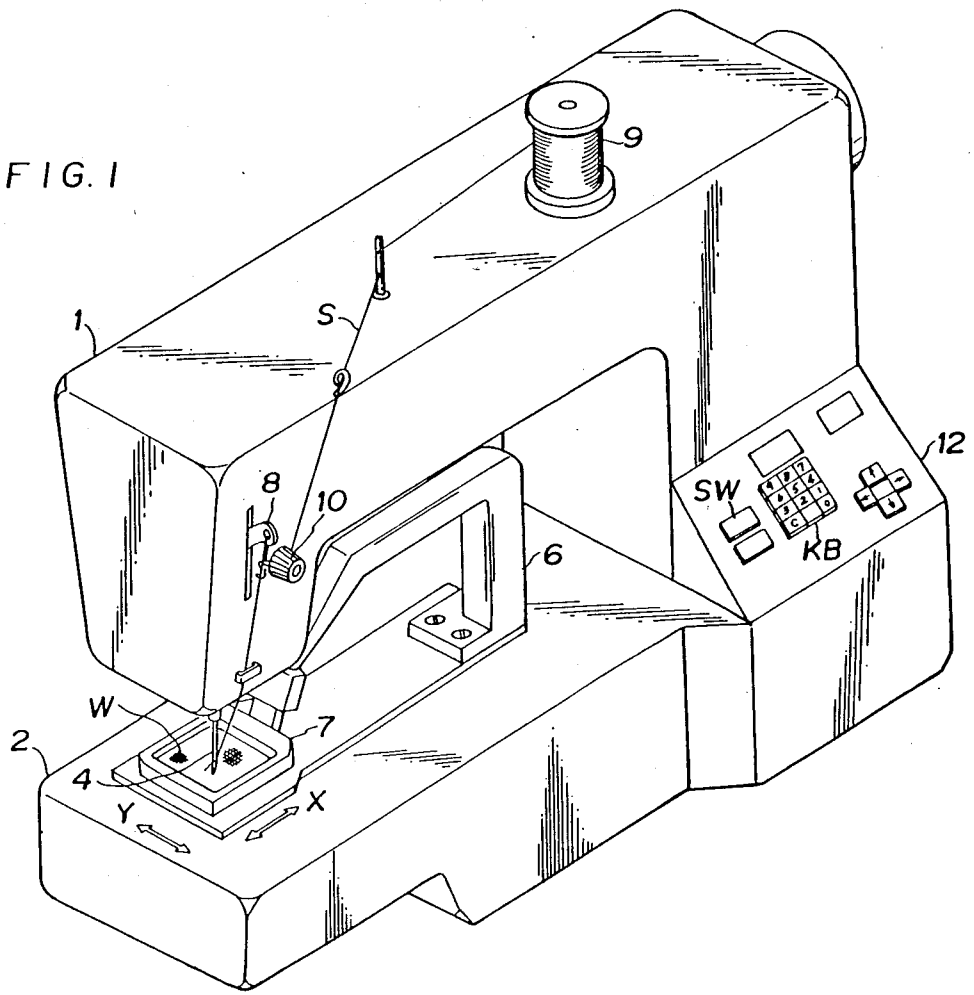
FIG. 1 is a perspective view of an automatic sewing machine incorporating a thread tightening control apparatus according to the present invention.
Figure 3:
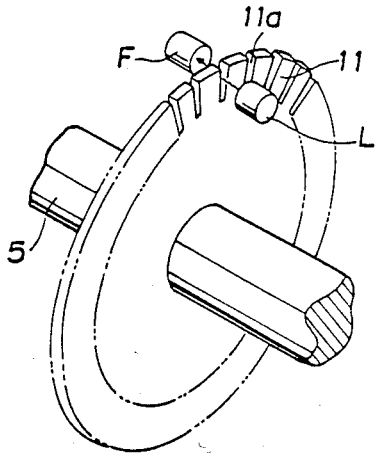
FIG. 3 is a perspective view of pulse generating means arranged in association with a spindle.

With reference to FIG. 1, there is shown an automatic sewing machine for performing, e.g., lock stitching and incorporating a thread tightening control apparatus in accordance with the present invention. The sewing machine essentially includes a main body 1, a head 2, a needle rod 3 having a needle 4 secured to its lower end and moved up and down in operative association with a spindle 5 (FIG. 3), and a moving body 6. A base end of the moving body 6 is coupled to a pair of stepping motors XM, YM (FIG. 4) so as to be moved in X and Y directions by an arrangement disclosed in, e.g., the publication of Japanese Patent Application Laid-Open No. 57-55177. Secured to a distal end of the moving body 6 is a frame-shaped fabric holding body (fabric presser body) 7 for holding a fabric.

Figure 6:
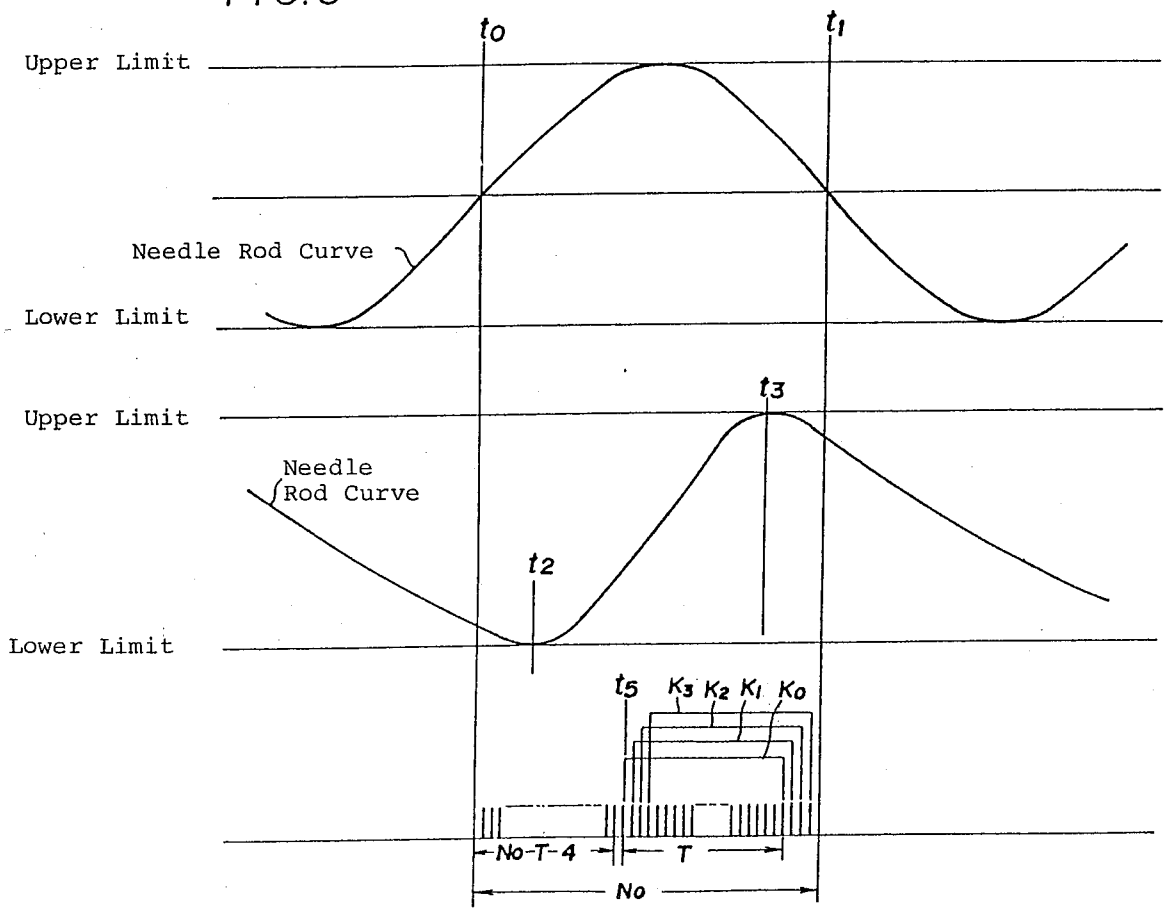
FIG. 6 is a time chart expressing the phase relation between the up-and-down motion of a needle and take-up lever and a fabric feed period.

A take-up lever 8 on the front side of the sewing machine 1 for delivering an upper thread S between a thread supply source 9 and the needle 4 moves up and down in operative association with a spindle 5 with a phase shown in FIG. 6.

A conventional, well-known thread adjuster 10, which is arranged in the upper thread path between the take-up lever 8 and the thread supply source 9 for grasping and tensioning the upper thread S, is adapted so as to be capable of regulating the tension of the upper thread by a manual operation.

On the inner side of the machine frame a rotary body 11 provided along its circumference with a plurality of equidistantly spaced slits 11*a* is secured to the spindle 5. Secured to the machine frame are light-receiving means F and light-emitting means L opposing each other across the rotary body 11 interposed therebetween. The light-receiving means F and light-emitting means L comprises pulse generating means DT for generating pulse signals at a fixed interval in synchronism with the rotation of the spindle 5, the signals being generated in response to light received by the light-receiving means L from the light-emitting means F through the slits 11*a*. It should be noted that the number of slits 11*a* is set in such a manner that $N_0$-number of pulse signals are generated from $t_0$ to $t_1$ in FIG. 6.

Situated on the front side of the sewing machine body 1 at the base portion thereof are a start switch SW and a keyboard KB which is for designating a pattern to be selected, for setting the enlargement or reduction ratio of the pattern as well as a feed tightening feed quantity, described below, and the like.

These operating members are provided on a control panel 12 detachable from the sewing machine main body 1. The control panel 12 and main body 1 are connected by a cord, which is not shown.

CONSTRUCTION OF CONTROL CIRCUIT

Figure 4:
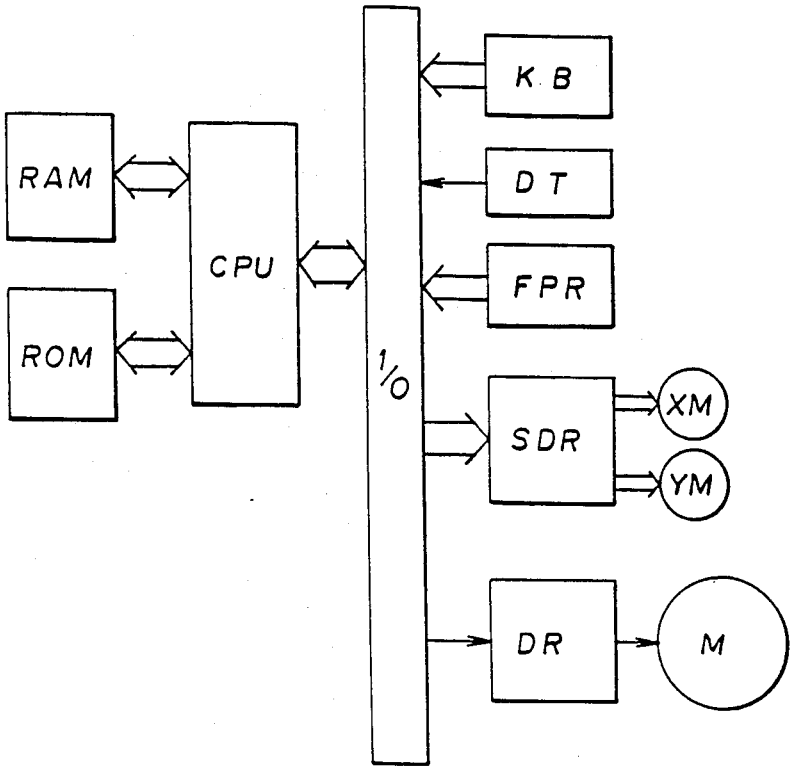
FIG. 4 is a block diagram of a control circuit.

In FIG. 4, RAM is a random-access memory into which data can be written and from which data can be read at will for temporarily storing data from a floppy disc. ROM represents a read-only memory solely for read-out and stores a program shown in FIG. 5. CPU denotes a central processing unit having arithmetic and input/output functions. SDR designates a drive circuit for generating step pulses applied to stepping motors XM, YM for driving the same. DR denotes a drive circuit for a motor M coupled to the spindle.

DT is the pulse generating means (FIG. 3) comprising the above-described rotary body 11, light-emitting body L and light-receiving body F. FPR represents reading means for reading data from a floppy disc (not shown) on which fabric feed quantities in the X and Y directions for every stitch of a sewing pattern are stored as data. I/O is an interface circuit for input and output of signals between the CPU and KB, DT, FPR, SDR, DR.

The control operation performed by the CPU will be described next.

First, let $X_1$, $Y_1$ represent the data indicative of the amounts of movement of the fabric holding body 7 in the X and Y directions, the amounts of movement being calculated on the basis of data on the floppy disc.

A control operation is performed in accordance with the main program (not shown) of the CPU. The control operation takes T as the larger of $X_1$, $Y_1$ and effects an interrupt to the subroutine of FIG. 5 with every generation of a pulse signal after having counted ($N_0$-T-4)-number of pulse signals from the instant in time $t_0$ at which the needle withdraws from and rises above the fabric.

Figure 5:
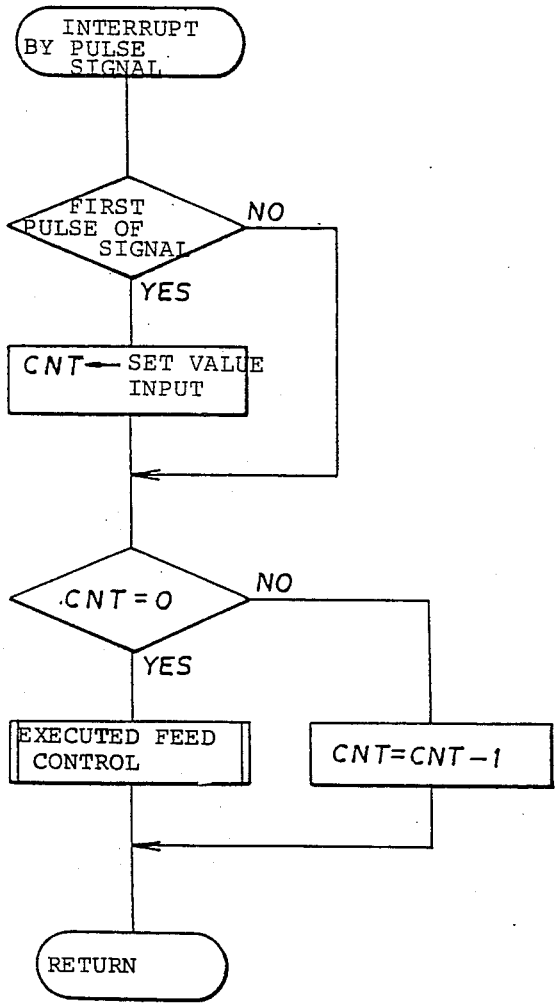
FIG. 5 is a flowchart of a subroutine called by pulse signal interrupt.

The flowchart of the subroutine shown in FIG. 5 will be described next. In FIG. 5, when the main program is interrupted in response to a pulsed signal, it is determined whether this is the first pulse of the signal, namely whether the signal is the ($N_0$-T-3)th pulse signal from the instant in time $t_0$, as far as the subroutine is concerned. If this is indeed the first pulse of the signal, then a set value n (assumed to be a value of from 0 to 3) which is for feed tightening and which is set by the keyboard KB is stored in a predetermined register CNT of the CPU. It is then determined whether the value of CNT is "0"; if it is, then one or both of the stepping motors XM, YM is driven one step based on the sewing pattern data. If the value of CNT is not "0", then the value of CNT is decremented. A return is effected to the main program at the conclusion of the foregoing processing.

In the foregoing, by starting the interrupt to the program of FIG. 5 after counting ($N_0$-T-4)-number of pulse signals from the instant $t_0$ onward, fabric feed periods $K_0$–$K_3$ are set in correspondence with respective ones of the set values "0–""3" for feed tightening. As a result, fabric feed completion timing can be set to conform to the end of the period in which the needle 4 withdraws from and rises above the fabric W. Thus, so-called feed tightening becomes possible.

In addition, the expression $N_0$-T-4 is determined by the fact that the set valuses for feed tightening are four-stage values, i.e., "0"–"3". In general, when the set values for feed tightening are capable of being set to m+1 stages, i.e., "0""m", the interrupt to the subroutine of FIG. 5 will take place after ($N_0$-T-m-1)-number of pulse signals are counted from the instant $t_0$ onward.

Operation

The upper thread S is passed through the needle 4 upon being guided successively through the thread adjuster 10 and take-up lever 8, and the fabric W is attached to the fabric holding body 7. Thereafter, power is introduced to the sewing machine 1 and the number and enlargement rate of a sewing pattern are entered by the keyboard KB. When this is done, sewing pattern data of the corresponding number are read from the floppy disc by the reading means FPR, fabric feed data in the X and Y directions for each and every stitch are calculated based on the data and pattern enlargement rate, and the calculated data are stored successively in the RAM.

When the storing of the data in the RAM ends, the operator uses the keyboard KB to set one of the values of from "0" to "3" in dependence upon the amount of feed tightening to be set.

We shall assume here that the article W to be stitched is a comparatively thin fabric, on the basis of which the operator sets the feed tightening quantity "2".

Next, when the start switch SW is pressed, the needle 4 pierces the fabric W and sewing starts.

When the needle 4 withdraws from and rises above the fabric W at $t_0$ (FIG. 6) following the piercing of the fabric, the CPU begins counting the pulse signals from the pulse generating means DT from this time onward.

The take-up lever 8 rises at instant $t_2$, whereby the upper thread S is pulled up. Thus starts thread tightening performed by the take-up lever.

Assume that the fabric feed quantity data at this time are $X_2$, $Y_2$ in the X and Y directions, respectively, and that $X_2 > Y_2$ holds. In such case the relation $T = X_2$ is established by the main program of the CPU. When the count of pulse signals recorded by the CPU exceeds ($N_0$-T-4) on the basis of the foregoing, an interrupt to the subroutine of FIG. 5 is made with every pulse signal.

At the $[(N_0\text{-}T\text{-}4)+1]$th pulse signal (position $t_5$ in FIG. 6) counting from $t_0$, namely at the first pulse signal as seen by the subroutine of FIG. 5, the value "2" set as the set value of feed tightening by the keyboard KB is stored in the predetermined register CNT of the CPU. Since the value of CNT is now "2", the value of CNT is decremented to "1" and a return is effected to the main program. Likewise, the value of CNT is decremented further to "0" by the interrupt resulting from the next pulse that occurs after $t_5$. Since CNT will be "0" owing to the interrupt caused by the second pulse that occurs after $t_5$, the stepping motors XM, YM are driven on the basis of fabric feed quantity data $X_2$, $Y_2$ in the X and Y directions, thereby moving the fabric holding body 7.

From this point onward the value of CNT remains "0" without being incremented or decremented by the pulse signal interrupts. The stepping motors XM, YM therefore continue to be driven.

Figure 2:
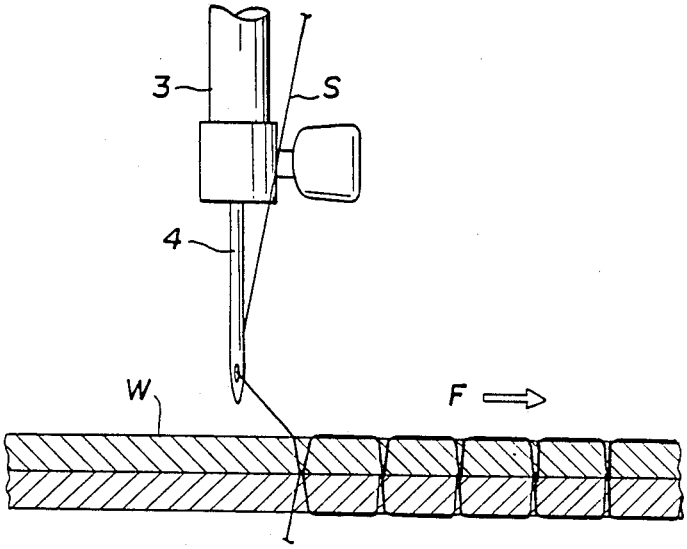
FIG. 2 is an explanatory view illustrating a feed-tightening action.

Since the fabric feed period in this case is $K_2$, as shown in FIG. 6, the fabric feed operation is continued by driving the stepping motor XM even after the end ($t_3$) of thread tightening performed by the take-up lever 8. In other words, the completion of fabric feed is timed to occur later than $t_3$, so that fabric feed ends after the needle 4 descends sufficiently. Consequently, the fabric holding body 7 is moved in the F direction even subsequent to $t_3$, as shown in FIG. 2. As a result, slack in the upper thread S extending from the needle 4 to the fabric W is taken up due to movement of the fabric holding body 7; hence, this portion of the thread is tightened.

Thereafter, when the needle 4 pierces the fabric W and is then withdrawn and raised from the fabric W, the pulse signals begin to be counted by the CPU in a manner similar to that described above and the fabric feed period $K_2$ is set, on the basis of the fabric feed quantity data, with respect to the timing at which thread tightening performed by the take-up lever 8 ends, as shown in FIG. 6. Specifically, the amount (feed tightening amount) the holding body 7 is moved following the instant at which thread tightening performed by the take-up lever 8 ends is set to be constant for every stitch.

Next, when sewing machine drive is temporarily halted, the fabric W is replaced by a thick fabric and "0" is set as the feed tightening quantity by the keyboard KB, processing proceeding to the program of FIG. 5 due to the interrupt at timing instant $t_5$ in FIG. 6. When this occurs, "0" is stored in CNT. Since CNT will then be "0", movement of the fabric holding body 7 starts immediately at timing $t_5$ and the fabric feed period in this case is $K_0$. However, $K_0$ is a period shifted further ahead (leftward in FIG. 6) than $K_2$ with respect to the timing instant $t_3$ at which the thread tightening performed by the take-up lever 8 ends. Accordingly, the amount of fabric feed after instant $t_3$ is less than that for $K_2$, and the height of needle 4 at the completion of fabric feed is greater than that for $K_2$. Consequently, the upper thread S leading from the fabric W to the needle 4 has its length extended and comes to be situated between the needle descent points of the fabric W. When the fabric W is thick, however, slack in the upper thread S is taken up by the fabric W even if the upper thread S is of some length. The proper seam will result.

It will be understood from the foregoing that for a fabric feed interval $K_i$ ($0 \leqq i \leqq 3$), smaller values of i are suitable for thicker fabrics, while larger values of i are suited to thinner fabrics.

OTHER EMBODIMENTS

According to the above-described embodiment, the set values of feed tightening quantity are entered by the keyboard KB. However, a special digital switch can be separately provided for this purpose. Alternatively, a potentiometer can be arranged on the fabric holding body 7 so as to produce a voltage that differes in dependence upon elevation of the fabric holding body 7, and the potentiometer voltage can be subjected to an A/D conversion before being applied to the CPU as the set value of the feed tightening quantity. Thus, an ideal feed tightening quantity can be set automatically in dependence upon the thickness of the fabric attached to the fabric holding body 7.

Further, according to the foregoing embodiment, the stepping motors XM, YM are used as the means for driving the fabric holding body 7. However, the invention is not limited to this embodiment, for servomotors, linear stepping motors and liner servomotors may also be employed.

ADVANTAGES OF THE INVENTION

According to the present invention as set forth above, in a cycle sewing machine adapted so as to establish relative movement between a needle and a fabric holding body by electrical drive means such as stepping motors, the timing of the relative movement between the needle and the fabric holding body which are to carry out feed tightening is made capable of adjustment by a manually operable switch, thereby enabling feed tightening adjustment in accordance with fabric thickness and the like merely by operating a simple switch. Accordingly, the invention is advantageous in that an attractive seam with the proper thread tightening can be obtained without requiring a high level of operating skill.

While the present invention has been described on the basis of a preferred embodiment thereof, various changes and modifications are possible without departing from the technical scope thereof.

We claim:

1. A thread tightening control apparatus of an automatic sewing machine, comprising:

a needle rod having a needle secured to a lower end thereof and movable up and down in operative association with a spindle;

a fabric holding body for holding a fabric at a lower end thereof and movable along a horizontal direction relative to the needle rod;

drive means coupled to the fabric holding body and operated by electrical drive pulses for driving the fabric holding body in a horizontal direction with respect to a needle descent point;

memory means for storing feed data which determine the amount of movement of the fabric holding body for each and every seam;

pulse generating means synchronized to the spindle for generating pulse signals of a constant period and of a number proportional to the rotational speed of the spindle;

actuating means for supplying the drive means with drive pulses in a period during which the needle is clear of the fabric in synchronism with said pulse signals and on the basis of the feed data in the memory means;

setting means capable of generating a plurality of setting signals of different timings at which the drive pulses are to be supplied to the drive means in dependence upon fabric thickness; and shifting means operable in association with the setting signals for moving a period during which the drive means is supplied with drive pulses by the actuating means forward or backward with respect to a predetermined rotational angle of the spindle.

2. The control apparatus according to claim 1, wherein said drive means is capable of driving said fabric holding body along perpendicularly intersecting X and Y axes lying in a horizontal plane, and said actuating means is adapted to supply drive signals in relation to an amount of movement of said fabric holding body along the X or Y axis, whichever is greatest.

3. The control apparatus according to claim 1, wherein said pulse generating means comprises a rotary body secured to the spindle and having equidistantly spaced slits along the circumference thereof, as well as light-emitting means and light-receiving means arranged to oppose each other across the rotary body interposed therebetween.

* * * * *